US007197259B2

(12) United States Patent
Ohshika

(10) Patent No.: US 7,197,259 B2
(45) Date of Patent: Mar. 27, 2007

(54) DEVELOPING APPARATUS AND IMAGE FORMING APPARATUS THAT INCORPORATES THE DEVELOPING APPARATUS

(75) Inventor: Hirotaka Ohshika, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/059,356

(22) Filed: Feb. 17, 2005

(65) Prior Publication Data

US 2005/0185981 A1 Aug. 25, 2005

(30) Foreign Application Priority Data

Feb. 24, 2004 (JP) ..... 2004-047824

(51) Int. Cl.
*G03G 15/08* (2006.01)

(52) U.S. Cl. ..... 399/103; 399/279; 399/286

(58) Field of Classification Search ..... 399/103, 399/279, 286; 492/27
See application file for complete search history.

(56) References Cited

U.S. PATENT DOCUMENTS 5,384,627 A * 1/1995 Behe et al. ..... 399/291
5,450,181 A * 9/1995 Tsukida et al. ..... 399/322
5,758,230 A * 5/1998 Nakaue et al. ..... 399/103
6,226,479 B1 * 5/2001 Karaki et al. ..... 399/159
6,314,263 B1 * 11/2001 Yoshida et al. ..... 399/286
6,405,003 B2 * 6/2002 Uehara ..... 399/103
6,424,813 B1 * 7/2002 Hatakeyama ..... 399/279

FOREIGN PATENT DOCUMENTS

JP 2003-043812 2/2003

* cited by examiner

*Primary Examiner*—David M. Gray
*Assistant Examiner*—Bryan Ready
(74) *Attorney, Agent, or Firm*—Rabin & Berdo, P.C.

(57) ABSTRACT

A developing apparatus includes a developing roller and a sealing member. The developing roller applies toner to an electrostatic latent image to develop the electrostatic latent image. The sealing member presses the developing roller to seal the developer. The apparatus includes a developing roller with a shaft and a resilient layer formed on the shaft. The developing roller rotates about the shaft. The resilient layer covers the outer circumferential surface of the developing roller and is in contact with the sealing member. The resilient layer has a diameter that becomes larger nearer longitudinal ends of the developing roller. The diameter has a maximum value and a minimum value. The difference between the maximum value and the minimum value is such that 10 μm<ΔΦ<300 μm, where ΔΦ is a difference between the maximum value and the minimum value.

14 Claims, 8 Drawing Sheets

DEVELOPING APPARATUS AND IMAGE FORMING APPARATUS THAT INCORPORATES THE DEVELOPING APPARATUS

BACKGROUND OF THE INVENTION

1. Field of the Invention

The present invention generally relates to an electrophotographic image-forming apparatus such as a printer and a facsimile machine.

2. Description of the Related Art

A conventional electrophotographic image-forming apparatus is of the configuration as shown in FIG. 1. A charging roller 2 charges the surface of a photoconductive drum 1. A light source 3 illuminates the charged surface of the photoconductive drum 1 in accordance with print data to form an electrostatic latent image. A developing roller 4 applies, for example, toner to the electrostatic latent image to develop the electrostatic latent image into a visible image. A toner-supplying roller 5 charges the toner and supplies the charged toner to the developing roller. A developing blade 6 forms a toner layer having a uniform thickness on the developing roller 4. A transfer roller 7 transfers the toner image from the photoconductive drum 1 onto a recording medium. A cleaning blade 8 collects residual toner remaining on the photoconductive drum that failed to be transferred onto the recording medium. Sealing members 9 are pressed against the circumferential surface of longitudinal end portions of the developing roller 4 to seal against the toner from leaking through the gaps in the vicinity of the longitudinal ends of the developing roller 4. The sealing member 9 effectively reduces the surface roughness of the developing roller 4 so that the toner is difficult to leak. Alternatively, a cylindrical film is attached to the longitudinal end portions of the developing roller 4 to prevent toner leakage.

However, the sealing members 9 pressed against the longitudinal end portions of the developing roller 4 are not sufficient and some toner still leaks. If the sealing member 9 is firmly pressed against the developing roller 4 prevents the toner leakage but the friction between the developing roller 4 and sealing members 9 increases. Thus, the force that presses the sealing members 9 should be limited.

SUMMARY OF THE INVENTION

An object of the invention is to prevent toner from leaking from a developing unit.

Another object of the invention is to provide a configuration of a developing apparatus in which a developing roller is in contact with a photoconductive drum to apply a substantially uniform pressure across the length of the photoconductive drum.

Still another object of the invention is to provide a configuration of a developing apparatus in which the toner is pushed back toward the middle portion of the developing roller, thereby preventing toner leakage.

Yet another object of the invention is to provide a configuration of a developing apparatus in which a sealing member is pressed against the surface of the end portion of the resilient layer of the developing roller, thereby preventing toner leakage.

A developing apparatus includes a developing roller that rotates on a shaft and applies developer to an electrostatic latent image formed on a photoconductive body to develop the electrostatic latent image into a visible image. A resilient layer covers an outer circumferential surface of the developing roller. The resilient layer being in contact with the sealing member, wherein said resilient layer has a diameter that becomes larger nearer a longitudinal end of the developing roller.

The diameter has a maximum value and a minimum value. The difference between the maximum value and the minimum value is such that $10\ \mu m<\Delta\Phi<300\ \mu m$, where $<\Delta\Phi$ is the difference between the maximum value and the minimum value.

The average diameter of particles of the developer is such that $\Delta\Phi>(50/\Psi)+5\ \mu m$, where $\Delta\Phi$ is an average diameter of the particles of the developer.

The resilient layer has a resin coating formed on it.

The resin coating has a thickness such that $2\ \mu m<t<100\ \mu m$ where t is the thickness.

The resilient layer has an outer diameter that becomes larger nearer a longitudinal end of the resilient layer.

The resilient layer has a first diameter at a longitudinal middle portion of said resilient layer and a second diameter at a longitudinal end of said resilient layer, the first diameter and the second diameter are related such that $\Phi end<\Phi mid$ where $\Phi mid$ is the first diameter and $\Phi end$ is the second diameter.

The resilient layer has a first diameter at a longitudinal middle portion and a second diameter at a point between the longitudinal middle portion and a longitudinal end, the second diameter being a smallest diameter across a length of said resilient layer, wherein the first diameter and the second diameter are such that $10\ \mu m<(\Phi mid-\Phi A)<500\ \mu m$, where $\Phi mid$ is the first diameter in μm and $\Phi A$ is the second diameter in μm.

The longitudinal end has a surface that lies in a plane at an angle other than 90 degrees with an axis of rotation of the developing roller.

The resilient layer has an outer surface that extends to continuously become further away from an axis of rotation of the developing roller with decreasing distance from a longitudinal end of the developing roller.

The resilient layer has an outer surface that extends to become further away from a rotational axis of the developing roller the axis nearer a longitudinal end of said resilient layer, the outer surface becoming further away from the rotational axis stepwise.

The resilient layer has an outer surface that becomes continuously further away from a rotational axis of the developing roller nearer a longitudinal end of said resilient layer.

The developing apparatus further includes a sealing member disposed to press a circumferential surface of the developing roller to seal the developer.

The developing apparatus further includes a sealing member (9A, 9A1) disposed to press a surface of a longitudinal end of the developing roller to seal the developer.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Construction}

Figure 1:
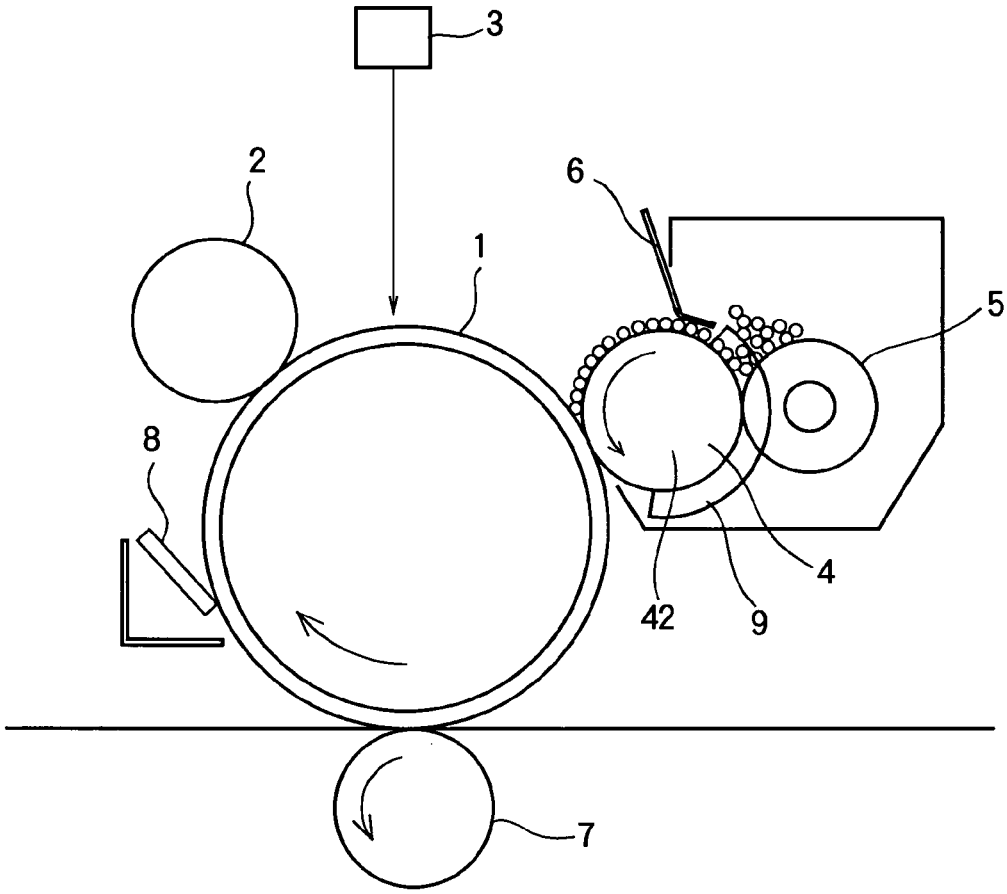
FIG. 1 is an electrophotographic image forming apparatus according to a first embodiment.

FIG. 1 is an electrophotographic image forming apparatus according to a first embodiment.

Referring to FIG. 1, a photoconductive drum 1, a charging roller 2, a light source 3, a developing roller 4, a toner-supplying roller 5, transfer roller 7 that extend longitudinally and rotate. The cleaning blade 8, a developing 6, and a sealing member 9 extend in their longitudinal directions. The charging roller 2, developing roller 4, transfer roller 7, cleaning blade 8 are in contact with the photoconductive drum 1. The developing blade 8 and toner-supplying roller 5 are adjacent to and parallel to the developing roller 4. The sealing member 9 is disposed in the vicinity of the longitudinal ends of the developing roller 4, being pressed against the circumferential surface of the developing roller 4.

Figure 2:
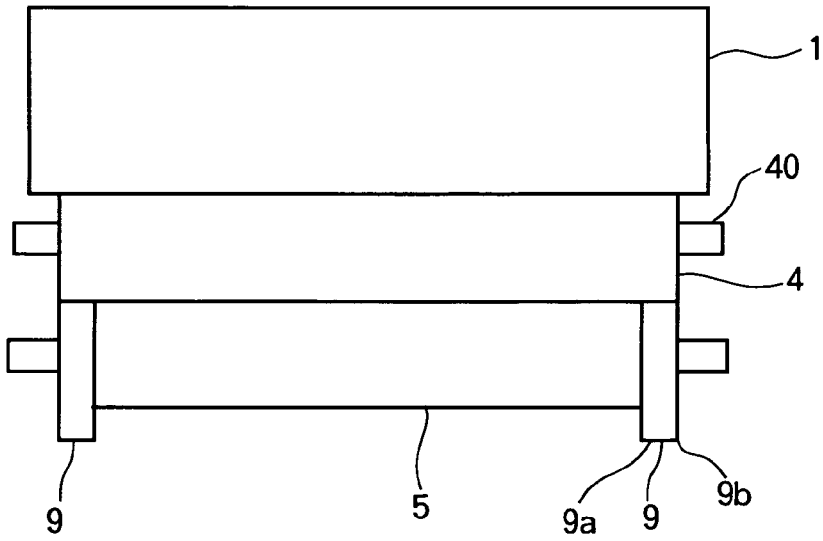
FIG. 2 illustrates the positional relation among a photoconductive drum, a developing roller, a toner-supplying roller, and a sealing member.

FIG. 2 illustrates the positional relation among the photoconductive drum 1, developing roller 4, toner-supplying roller 5, and sealing member 9. The sealing members 9 are pressed against the developing roller 4 in such a way that an inner circumferential surface 9*a* of the sealing member 9 is in intimate contact with an outer circumferential surface of the developing roller 4. The sealing member 9 is disposed so that a corner 9*b* of the sealing member 9 does not press the developing roller 4. As shown in FIG. 1, the developing roller 4 rotates counterclockwise so that the developing blade 6 slides on the developing roller 4 clockwise relative to the developing roller 4. Alternatively, the developing blade 6 and developing roller 4 may be configured such that the developing roller 4 rotates clockwise and the developing blade 6 slides on the developing roller 4 counterclockwise relative to the developing roller 4. The developing roller 4 has a metal shaft 42 covered with a resilient layer 42. In the first embodiment, the resilient layer 42 is a single layer but may also be of multi-layer structure, e.g., dual-layer structure. For example, an inner layer is made of a material having a low hardness and an outer layer is made of a material having a high hardness. Such a dual-layer structure offers a soft developing roller in which the developing roller 1 will not be dented at an area in contact with the photoconductive drum 1 even if the dual-layer structure is left inoperative for a long time. The resilient layer 42 is preferably formed of a resilient material such as urethane rubber or semiconductive silicone rubber.

The longitudinal end portions of the developing roller 4 have a diameter that becomes larger nearer the longitudinal ends. It is to be noted that the diameter does not change linearly but exponentially. The sealing members 9 are in contact with the circumferential surface of the longitudinal end portions. The geometry of the longitudinal end portions may be shaped using a metal mold and is then subjected to polishing for a final shape. Alternatively, the developing roller may be molded or extruded, and the developing roller 4 may then be polished into a desired final shape.

Figure 3A:
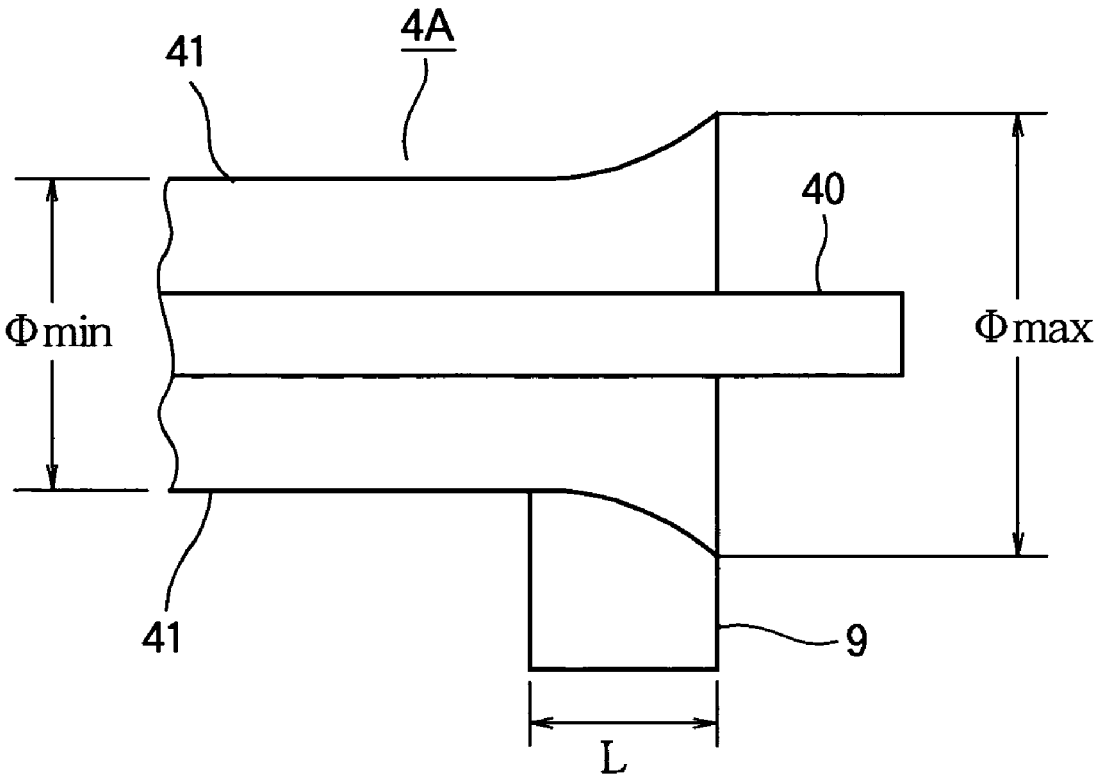
FIGS. 3A–5B show various shapes of the developer roller.
Figure 3B:
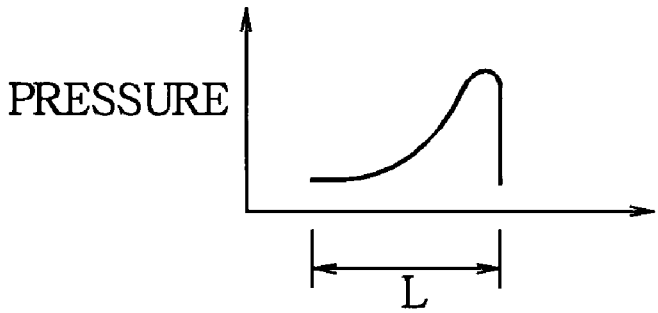
Figure 4A:
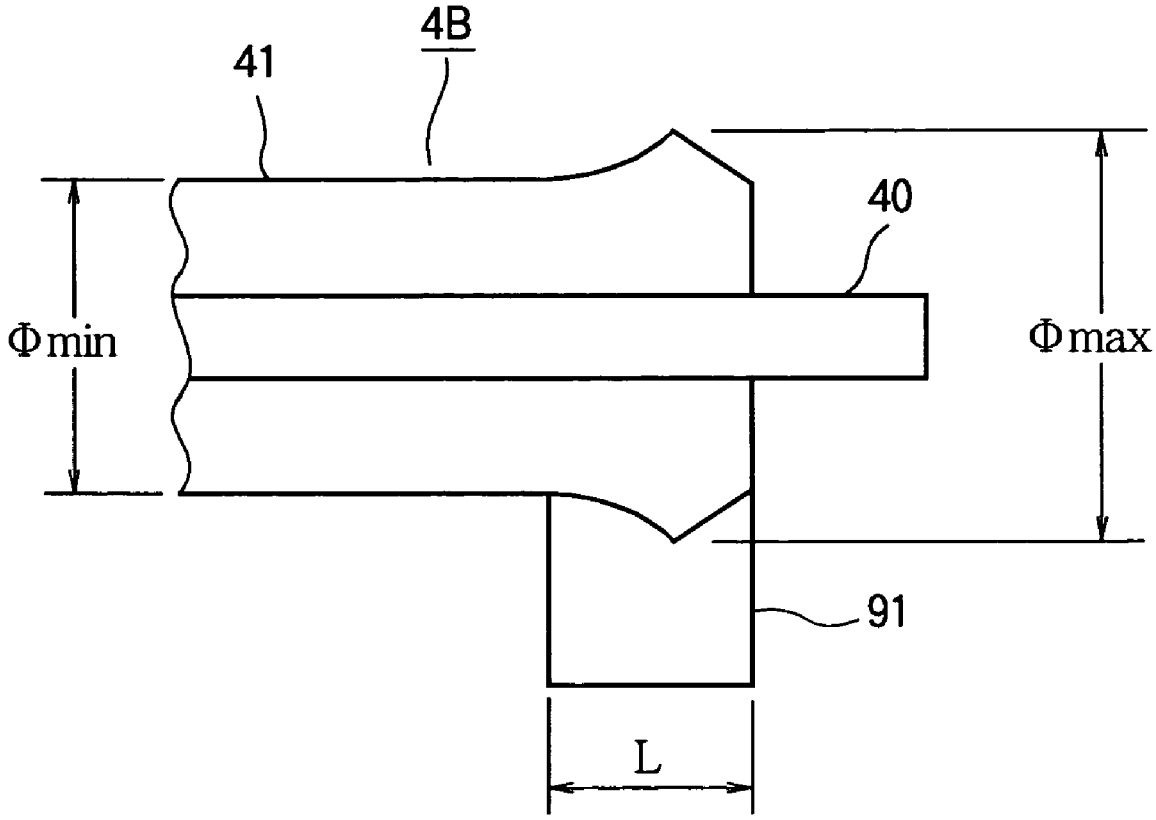
Figure 4B:
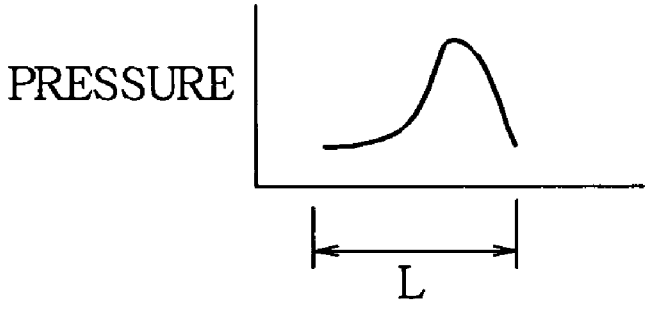
Figure 5A:
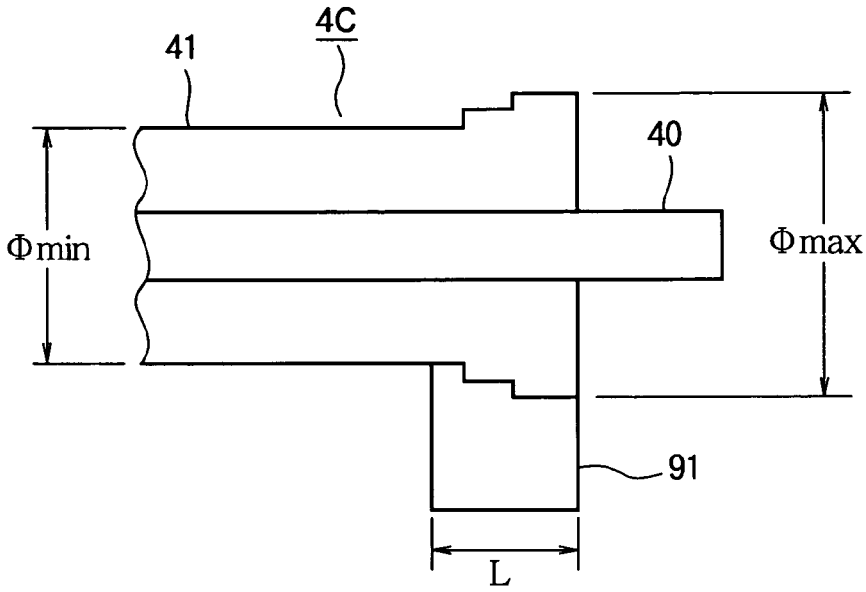
Figure 5B:
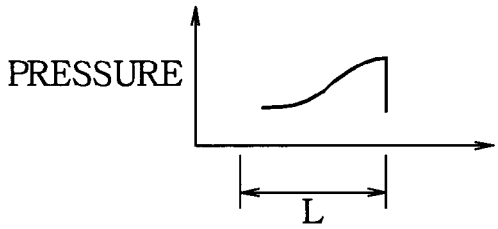

FIGS. 3A–5B show various shapes of the developer roller 4. FIG. 3A is a cross-sectional view of a developing roller 4A and FIG. 3B illustrates the pressure that is exerted on the sealing member 9 in the vicinity of longitudinal end portions of the developing roller 4A. FIG. 4A is a cross sectional view of a developing roller 4B and FIG. 4B illustrates pressure that is exerted on the sealing member in the vicinity of longitudinal end portions of the developing roller 4B. FIG. 5A is a cross sectional view of a developing roller 4C and FIG. 5B illustrates pressure that is exerted on the sealing member 9 in the vicinity of longitudinal end portions of the developing roller 4C. The longitudinal end portions of the developing roller 4 may be made at will in any shapes during polishing, by adjusting the speed and pressure with which the polishing is performed in an axial direction of the developing roller. For example, the developing roller 4A in FIG. 3A has a diameter that becomes continuously progressively larger nearer the longitudinal ends of the developing roller 4A. The developing roller 4B in FIG. 4A is tapered linearly toward the longitudinal ends. The developing rollers 4A and 4B may be shaped in appropriate known methods. The diameter of the developing roller 4C in FIG. 5A becomes continuously progressively larger nearer the longitudinal ends of the developing roller 4C. Such a shape needs to be formed by molding. The developing rollers 4A–4C preferably have a circumferential surface in contact with the sealing member 9, the circumferential surface having a maximum diameter $\Phi max$ and a minimum diameter $\Phi min$ such that $10\ \mu m < \Delta\Phi < 300\ \mu m$ ($\Delta\Phi = \Phi max - \Phi min$). When toner particles have an average diameter of $\Psi$, it is desirable that $\Psi < \Delta\Phi$.

Figure 6:
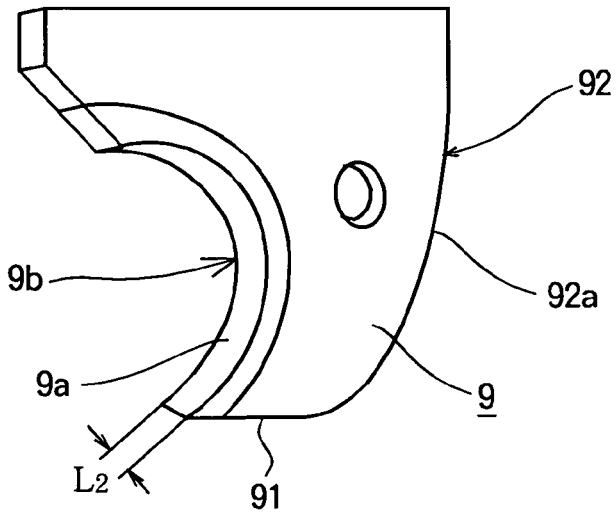
FIG. 6 illustrates the configuration of the sealing member.

FIG. 6 illustrates the configuration of the sealing member 9. The sealing member 9 includes a felt 91 and a foamed resilient body 92. The felt 91 has a surface in direct contact with the developer roller 4. The surface has a shape that is configured to mate with the circumferential surface of the developing roller 4. The width L2 of an area of the sealing member 9 in contact with the developing roller 4 is preferably in the range of 3 to 15 mm. The resilient body 92 has a hole 92*a* through which a shaft of the toner-supplying roller 5 extends.

When the developing roller 4 is driven to rotate counterclockwise, the developing blade 6 forms a layer of toner having a uniform thickness on the developing roller 4. The layer of toner is strongly attracted by the Coulomb force to the developing roller 4 and will not leak to the outside environment. The toner-supplying roller 5 scrapes the toner off the developing roller 4 as well as supplying fresh toner to the developing roller 4. The electrostatic force no longer affects residual toner scraped by the toner-supplying roller 5. Thus, the sealing member 9 is effective in preventing the scraped toner from leaking to the outside environment. The diameter of the developing roller 4 near its longitudinal end portions becomes larger nearer the longitudinal ends of the developing roller 4. Thus, the sealing member 9 does not exert a pressing force that is uniformly distributed across the length of the developing roller 4 but a pressing force that becomes larger nearer the longitudinal ends. This profile of distribution of the pressing force is effective in preventing the toner from leaking toward the longitudinal ends of the developing roller 4.

The pressing force exerted by the sealing member 9 on the developing roller 4 is proportional to the $\Delta\Phi$. For $\Delta\Phi$ smaller than 10 μm, the pressing force is distributed relatively uniformly and is therefore not effective in blocking the leakage of the toner. For $\Delta\Phi$ larger than 300 μm, a gap is created between the developing roller 4 and the sealing member 9, so that the toner accumulates between the developing roller 4 and the sealing member 9 to cause "filming." The filming of toner scratches the developing roller 4 to cause grooves in the developing roller 4 through which the toner leaks. The smaller the particle diameter of toner is, the larger the $\Delta\Phi$ should be, so that the particle diameter and the $\Delta\Phi$ are inversely proportional. In other words, there is a relation that $\Delta\Phi>(a/\Psi)+b$ (a and b are fixed values). The values of a and b can be calculated from the data listed in Table 1. The values of $\Psi$ and $\Delta\Phi$ that provide the advantages listed in Table 1 are put into Equation $\Delta\Phi>(a/\Psi)+b$. In other words, $(\Psi, \Delta\Phi)=(4, 20)$, $(6, 15)$, $(8, 15)$, and $(10, 10)$ are put into Equation $\Delta\Phi>(a/\Psi)+b$, thereby calculating the values of a and b. The thus calculated values of a and b are 50 and 5, respectively. The data in Table 1 reveal that toner will not leak if $\Delta\Phi>(50/\Psi)+5$ μm.

TABLE 1

| | Δ Φ (μm) | | |
|---|---|---|---|
| Ψ (μm) | 10 | 15 | 20 |
| 4 | x | x | ○ |
| 6 | x | ○ | ○ |
| 8 | x | ○ | ○ |
| 10 | Δ | ○ | ○ |

Δ: leakage is serious toward the end of lifetime of the developing roller.

Because the longitudinal end of the developing roller 4B has not the largest diameter, the pressing force exerted by the sealing member 9 is concentrated on the largest diameter portion, so that the developing roller 4B is subjected to serious wear. If the sealing member 9 is disposed in such a way that the largest diameter portion is closer to the longitudinally middle portion of the developing roller 4B than the mid point in the width of the sealing member 9, the effective areas for sealing become smaller. If the diameter of the developing roller 4 is formed to have a diameter that rapidly changes, then a gap will be created between the developing roller 4B and the sealing member 9. This gap allows the toner to be deposited on the developing roller 4B to cause filming, the filming of toner scratching the developing roller 4B. Thus, the diameter of the developing roller should not change rapidly. For developing rollers 4A and 4C, the diameter is a maximum at the longitudinal ends and therefore the pressing force will decrease. The pressing force acts toward the longitudinal ends of the developing roller, so that the wear of the developing rollers in FIGS. 3A and 4A will be reduced. The diameter of the developing roller 4C in FIG. 5A increases stepwise toward the longitudinal ends, thus the step size should be as small as possible so as not to create gaps at the corner portions.

The developing rollers 4A–4C allow the sealing members 9 to be pressed against the developing roller in a limited area without increasing the pressing force. In addition, the shape of the end portions of the developing rollers 4A–4C creates a force tending to push the toner toward the longitudinally middle portions of the developing rollers. Thus, the toner will not migrate toward the longitudinal end portions, firmly sealing the toner which would otherwise adhere to the drive gears to cause an increase in drive torque. Further, the toner is prevented from falling on the recording medium and therefore does not cause soiling of the recording medium.

Second Embodiment

Figure 7:
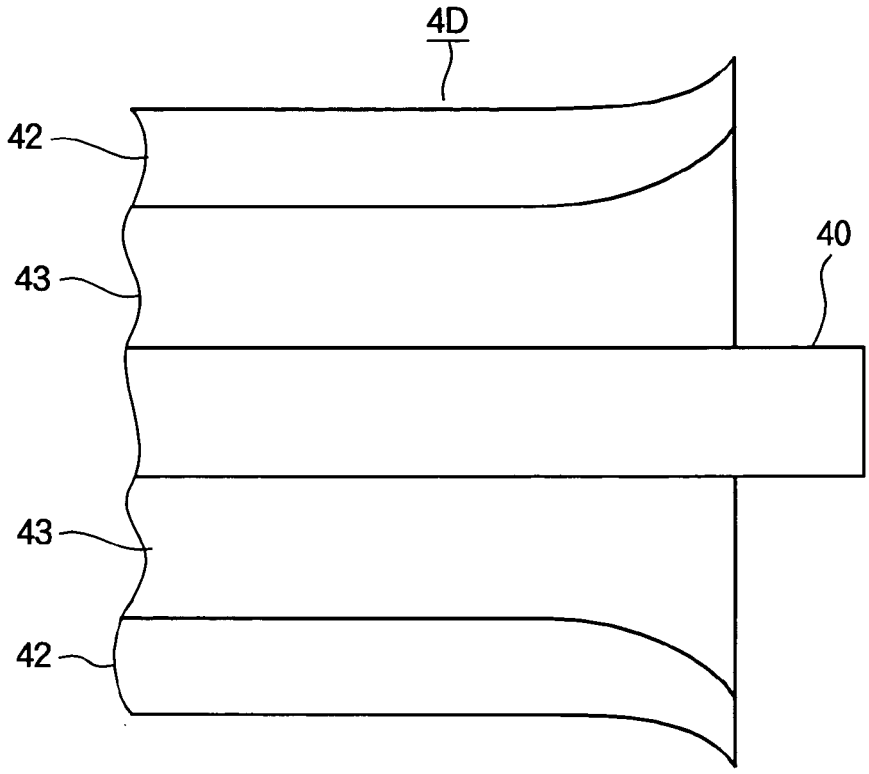
FIG. 7 is a cross-sectional view of a developing roller according to a second embodiment.

An electrophotographic image forming apparatus according to a second embodiment has the same configuration as the first embodiment. FIG. 7 is a cross-sectional view of a developing roller 4D. The developing roller 4D is provided with a resilient layer 43 that covers the outer circumference of a meal shaft 40. The resilient layer 43 is formed of a semiconductive material such as silicone rubber or urethane. The developing roller 4D is polished at an area in contact with a sealing member 9 in such a way that the diameter becomes larger nearer the longitudinal ends. It is to be noted that the diameter does not change linearly but exponentially. In other words, the developing roller 4D is shaped such that the diameter of the resilient layer 43 becomes larger nearer the longitudinal ends. The resilient layer 43 may be of dual-layer structure as in the first embodiment, in which case, a resin coating 42 formed of, e.g., urethane resin, is formed as a second layer on the resilient layer 43.

The resin coating 42 has a resin coating having a uniform thickness in the range of 2 to 100 μm. A resin coating 42 having a thickness smaller than 2 μm causes a poor durability. The resin coating 42 is harder than the resilient layer 43 and therefore the change in shape at the longitudinal ends is smaller than the resin coating 42. If the thickness of the resin coating 42 is greater than 100 μm, the change in the diameter of the developing roller 4D is too small near the longitudinal ends, not being effective in preventing toner leakage.

Resin coating is small in surface roughness and viscosity as compared to semiconductive rubber, and therefore resin coating has good sliding ability. Because the resin coating 42 covers the surface of the developing roller 4D, the toner is easy to slip on the resin coating 42. For this reason, the toner-supplying roller 5 can effectively scrape the toner on the developing roller 4D, preventing an "after-image" from occurring. This also prevents filming on the developing roller 4D due to adhesion of toner that would otherwise fail to be scraped by the toner-supplying roller 5. However, the good ability of resin coating to slide reduces the friction between the developing roller 4D and the toner-supplying roller 5. As a result, the toner entered between the developing roller 4D and the sealing member 9 tends to move in an axial direction. Thus, if the pressing force between the developing roller 4D and sealing member 9 is distributed uniformly, the toner is apt to leak from the inside of the developing unit to the outside of the developing unit. However, the diameter of the resilient layer 43, which becomes larger nearer the longitudinal end of the developing roller 4D, exerts a force on the coating 42, the force causing the resin coating 42 to widen outwardly. Therefore, despite the fact that the resin coating 42 is made of a material having a uniform thickness, the developing roller 4D has an overall diameter that becomes large nearer the longitudinal ends. Even if the toner enters between the developing roller 4D and the sealing member 9, the toner is pushed back toward the inner space of the developing unit.

Resin coating is harder than semiconductive rubber, so that the resin coating is difficult to be polished to into a shape such that the diameter becomes larger nearer the longitudinal ends. In the second embodiment, the resilient layer 43 of the developing roller 4D is formed such that the diameter becomes larger nearer the longitudinal ends. Therefore, despite the fact that the resilient layer 43 is covered with the resin coating 42, an area on the developing roller 4D in contact with the sealing member 9 also becomes larger in diameter nearer the longitudinal ends. This provides the developing roller 4D that prevents the toner from leaking to the outside environment and allows the toner to slide thereon.

Third Embodiment

Figure 8A:
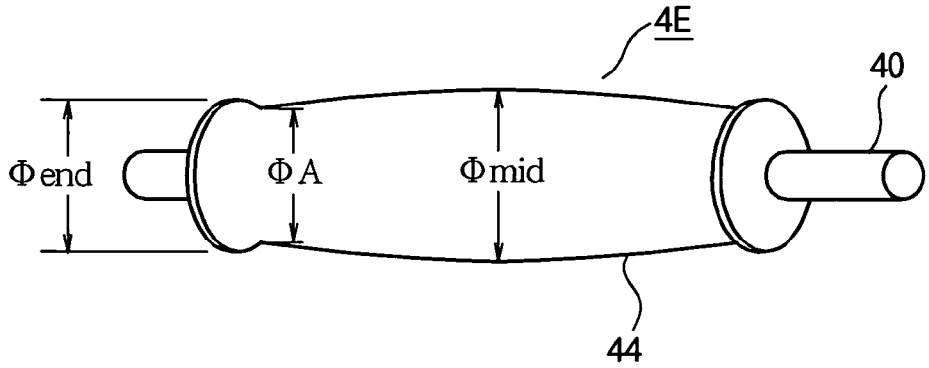
FIG. 8A is a perspective view illustrating the overall shape of a developing roller according to a third embodiment.
Figure 8B:
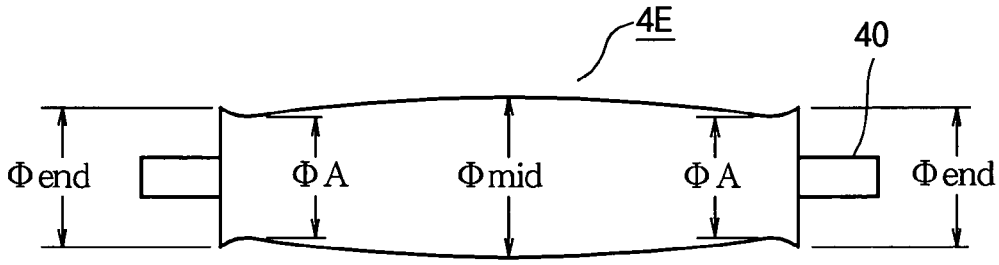
FIG. 8B is a front view of the developing roller.

An electrophotographic image forming apparatus according to a third embodiment is of the same configuration as the first embodiment. FIG. 8A is a perspective view illustrating the overall shape of a developing roller 4E. FIG. 8B is a front view of the developing roller 4E. The developing roller 4E has a metal shaft 40 covered with a resilient layer 44. The resilient layer 44 may be of dual-layer structure. The developing roller 4E is formed such that the diameter is a maximum (Φmid) at the longitudinally middle portion and becomes continuously progressively smaller nearer the longitudinal end portions to reach a minimum (ΦA) nearer the ends, and then again becomes larger nearer the longitudinal ends, reaching Φend at the longitudinal ends. A sealing member 9 is in contact with the outer surface of the developing roller 4E that extends from ΦA to Φend. The diameters Φend and Φmid are related such that Φend<Φmid. The diameters Φmid and ΦA are related such that 10 μm<(Φmid−ΦA)<200 μm.

In the first embodiment, the developing rollers 4A, 4B, and 4C are pressed against the photoconductive drum 1 with a certain pressing force. Therefore, the pressing force exerted on the surface of the photoconductive drum 1 by the developing roller is a maximum at the longitudinal ends and a minimum at the longitudinal middle portion. Thus, the efficiency of the toner to be deposited on the photoconductive drum 1 is not uniform along the length of the photoconductive drum 1.

In contrast, the developing roller 4E according to the third embodiment provides a substantially uniform profile of the distribution of pressing force across the entire length of the photoconductive drum 1. For Φmid<Φend, there is no advantage of having a diameter that becomes larger nearer the longitudinal middle. If the developing roller 4E has too large a diameter at the longitudinally middle portion, the pressing force tends to be concentrated to the longitudinal middle. Thus, for the developing roller 4E, when the minimum diameter is ΦA, the diameters Φmid and ϕA are related preferably such that 10 μm<(Φmid−ΦA)<500 μm.

When the developing roller 4E and the photoconductive drum 1 are in pressure contact with each other, because the pressing force is uniform along the length of the developing roller 4E, the movability of the toner from the developing roller 4E to the photoconductive drum 1 can be uniform across the length of the developing roller 4E. Thus, the density of an image becomes substantially the same across the width of an image formed on the recording medium. Moreover, the pressure acting between the photoconductive drum 1 and the developing roller 4E is not concentrated on the longitudinal end portions, and therefore deteriorated toner will not accumulate in the vicinity of the longitudinal end portions of the developing roller 4E.

Fourth Embodiment

Figure 9A:
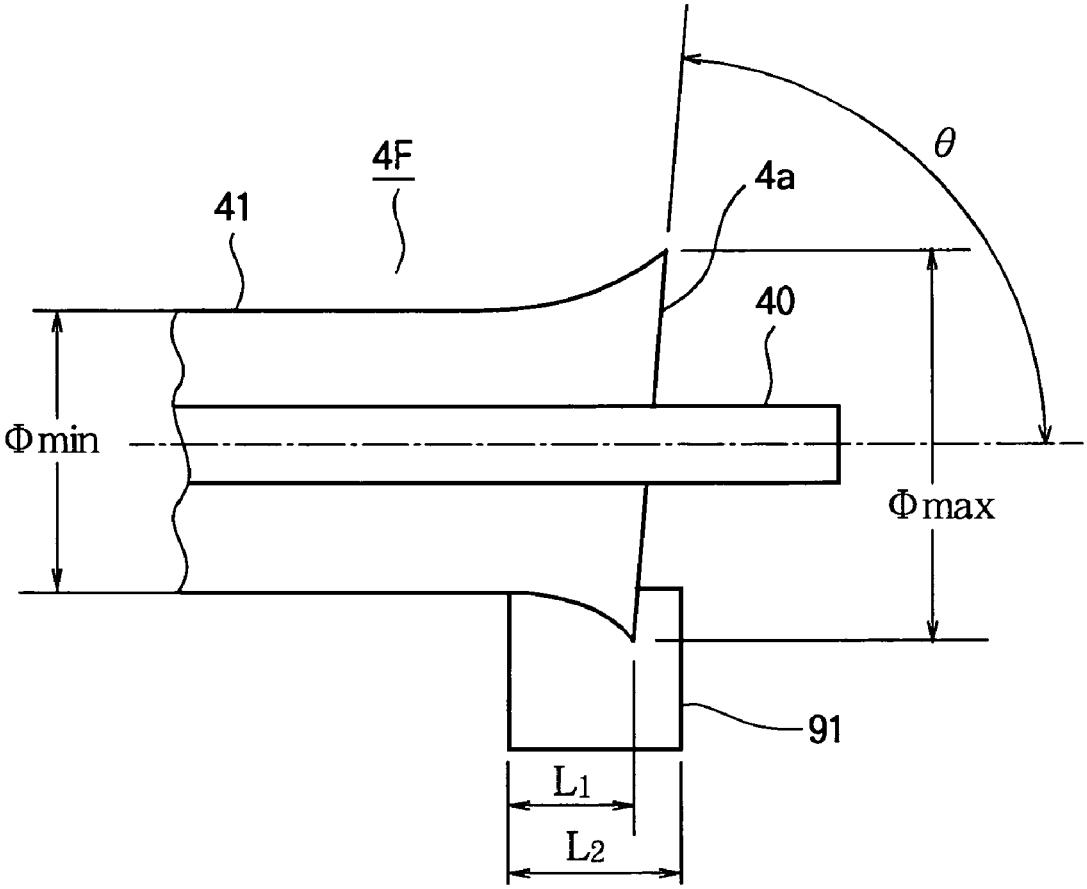
FIG. 9A is a cross-sectional view of a developing roller according to a fourth embodiment.
Figure 9B:
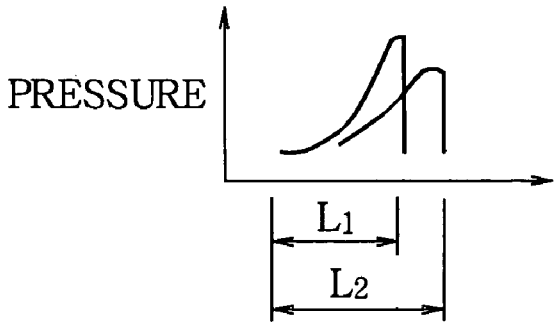
FIG. 9B illustrates the pressure exerted on a sealing member in the vicinity of longitudinal end portions of the developing roller.

An electrophotographic image forming apparatus according to a fourth embodiment is of the same configuration as the first embodiment. FIG. 9A is a cross-sectional view of a developing roller 4F and FIG. 9B illustrates the pressure exerted on a sealing member 9 in the vicinity of longitudinal end portions of the developing roller 4F. The developing roller 4F has a metal shaft 40 covered with a resilient layer 41. The resilient layer may be of multi-layer structure. The developing roller 4F is formed such that the longitudinal end surface 4*a* lies in a plane at an angle θ other than 90 degrees with a rotational axis of the developing roller 4F. The outline of the geometry of the developing roller 4F is preferably formed by using a metal mold and the thus formed developing roller 4F is polished into precise dimensions. The surfaces of the longitudinal end portions of the developing roller 4F are formed during the polishing stage such that the diameter becomes larger nearer the longitudinal ends. It is to be noted that the diameter does not change linearly but exponentially. The developing roller 4F may also be shaped by other methods such as extrusion molding, injection molding, and cutting. The difference in the longitudinal dimension of the surface of the developing roller 4F is preferably in the range of ½ to ⅔ of the width of the sealing member 9.

When the developing roller 4F rotates, the developing roller 4F rubs the sealing member 9. The sealing member 9 exerts a frictional force on the developing roller 4F so that the developing roller 4F is twisted by a torsional force exerted at its longitudinal ends. Because the resilient layer 41 of the developing roller 4F tends to correct the torsion, a force acts on the toner in such a direction as to push the toner toward the longitudinally middle portion of the developing roller 4F. The force that acts on the toner is a maximum at the longitudinal end of the developing roller 4F. This longitudinal end lies in a plane at an angle other than 90 degrees with the rotational axis of the developing roller 4F. Thus, when the developing roller 4F rotates about its rotational axis, the longitudinal ends repeat its reciprocating motion along the rotational axis. This increases the force tending to push back the toner toward the longitudinally middle portion of the developing roller 4F. In other words, a force acting in a direction toward the longitudinally middle portion of the developing roller 4F is greater than a force acting in a direction toward the longitudinal end. Thus, leakage of the toner is effectively prevented.

Fifth Embodiment

In the first to fourth embodiments, the developing roller is shaped to have a diameter that becomes larger nearer the longitudinal ends and the Coulomb force attracts the toner to the developing roller, thereby preventing the toner from leaking. However, some of the toner may still leak. In a fifth embodiment, a sealing member 9 is pressed against a resilient layer 45 of a developing roller 4G. Even when the toner layer is formed on the full length of the developing roller 4G, the toner is prevented from leaking to the outside environment.

Figure 10:
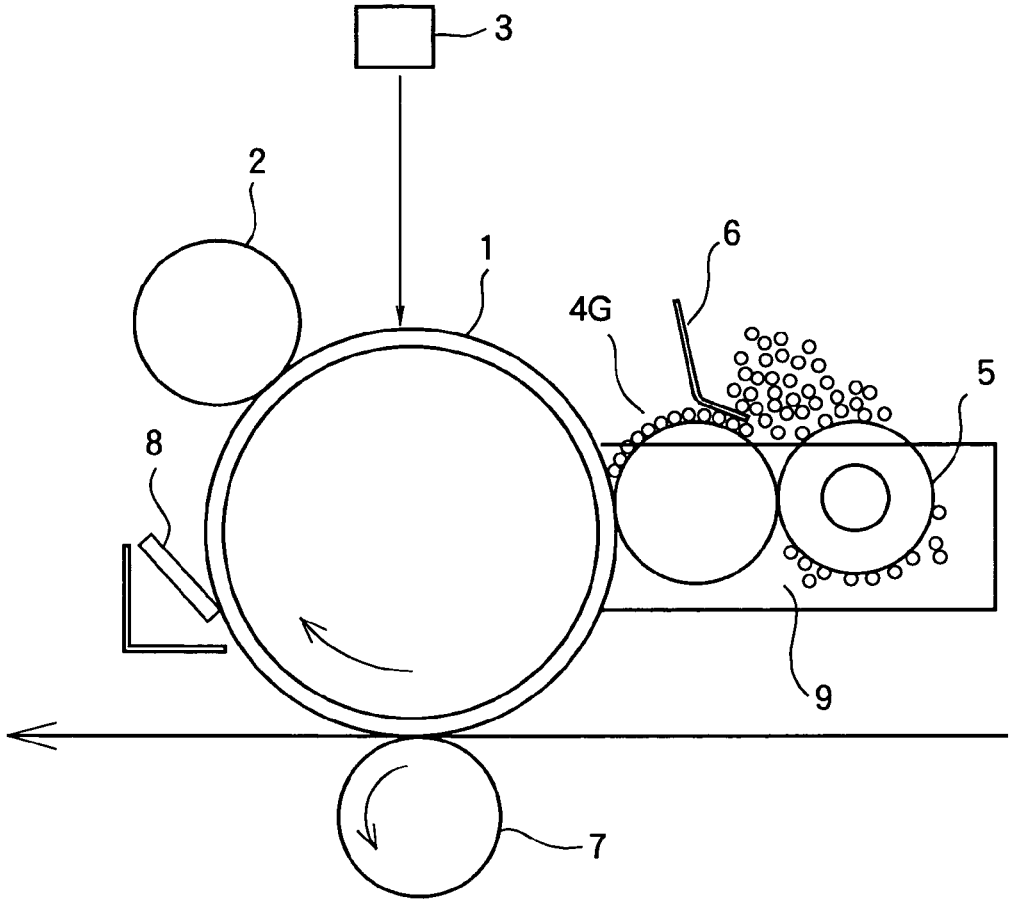
FIG. 10 illustrates an electrophotographic image forming apparatus according to a fifth embodiment.

FIG. 10 illustrates an electrophotographic image forming apparatus according to the fifth embodiment. The image forming apparatus includes a photoconductive drum 1, a charging roller 2, a light source 3, a developing roller 4G, a toner-supplying roller 5, a developing blade 6, a transfer roller 7, a cleaning blade 8, and a sealing member 9A.

Figure 11:
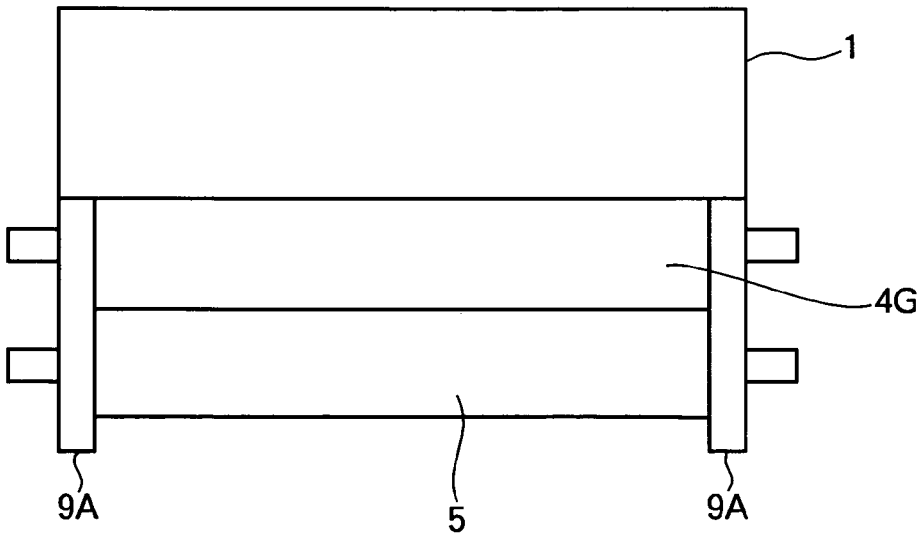
FIG. 11 illustrates the positional relation among a photoconductive drum, a developing roller, a toner-supplying roller, and a sealing member.
Figure 12:
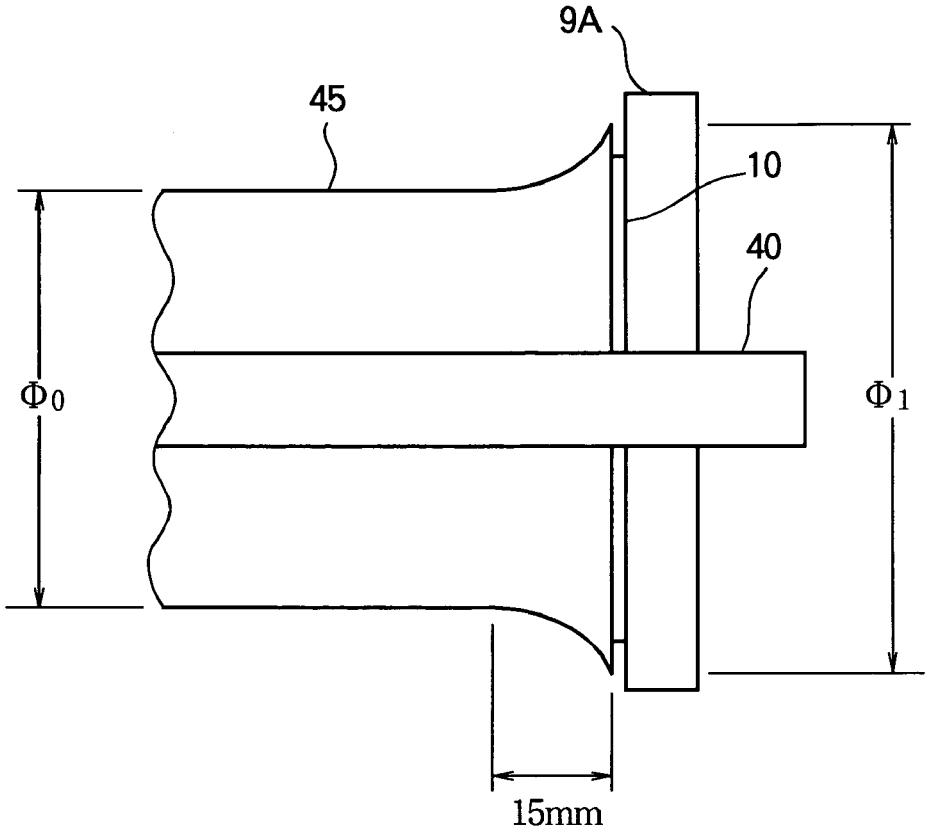
FIG. 12 is a cross-sectional view of the developing roller.
Figure 13:
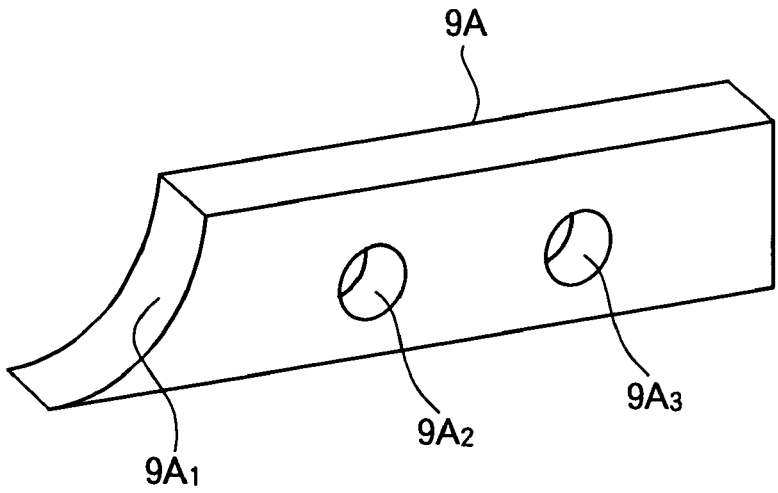
FIG. 13 illustrates the sealing member.

FIG. 11 illustrates the positional relation among the photoconductive drum 1, developing roller 4G, toner-supplying roller 5, and sealing member 9A. FIG. 12 is a cross-sectional view of the developing roller 4G. FIG. 13 illustrates the sealing member 9A. The sealing member 9A is preferably made of a foamed resilient material but may be formed of other materials such as a foamed material, plastics, or metal. The sealing member 9A is formed with holes 9A2 and 9A3 therein through which a shaft 40 of the developing roller 4G and a shaft of the toner-supplying roller 5 extend, respectively. The developing roller 4G has the shaft 40 covered with the resilient layer 45. The resilient layer 45 may be of multi-layer structure.

If the sealing member 9A is to be in direct contact with the photoconductive drum 1, the sealing member 9A is formed to have an area 9A1 that is configured to accommodate the circumferential surface of the photoconductive drum 1. The sealing member 9A has a flat surface that is in contact with the longitudinal end of the resilient layer 45. In order to prevent wear of the sealing member 9A and the resilient layer 45, a thin ring-shaped film 10 may be inserted between the sealing member 9A and the developing roller 4G. The thin ring-shaped film 10 has a thickness of about 10 μm and an outer diameter smaller than that of the longitudinal end of the developing roller 4G.

The resilient layer 45 is formed such that the diameter becomes larger nearer the longitudinal end of the resilient layer 45, starting 15 mm from the longitudinal end. The diameter of the resilient layer 45 is related such that $10\ \mu m<(\Phi 1-\Phi 0)<300\ \mu m$. The surface of the longitudinal end of the resilient layer 45 of the developing roller 4G lies in a plane substantially perpendicular to the shaft 40. The sealing member 9A may also be applied to the developing roller 4D according to the second embodiment and the developing roller 4E according to the third embodiment.

A frictional force exists between the sealing member 9 and the developing roller G. When the developing roller 4G rotates, the frictional force causes the end portions of the resilient layer 45 to twist. The torsional force acts toward the rotational axis of the developing roller, so that a gap tends to be created between the developing roller 4G and the sealing member 9A. The geometry of the resilient layer 45 is such that the diameter of the resilient layer 45 extends to become away from the rotational axis of the resilient layer toward the longitudinal ends of the resilient layer 45. It is to be noted that the diameter does not change linearly but exponentially. The resilient force acts radially outwardly of the developing roller and is greater than the torsional force acting toward the rotational axis of the developing roller. Thus, a gap is difficult to be created between the developing roller 4G and the sealing member 9A. Because the outer diameter of the thin ring-shaped film 10 is smaller than that $\Phi 1$ of the longitudinal end of the developing roller 4G, the thin ring-shaped film 10 is intimate contact with the resilient layer 45. Thus, a gap is not created between the resilient layer 45 of the developing roller 4G and the sealing member 9A and therefore the toner will not leak between the sealing member 9 and the thin ring-shaped film 10.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developing apparatus including a developing roller that rotates and applies developer to an electrostatic latent image formed on a photoconductive body to develop the electrostatic latent image into a visible image, and a sealing member that is in pressure contact with the developing roller to seal the developer, wherein the developing roller comprises:

a shaft that rotates; and a resilient layer that covers an outer circumferential surface of said shaft, said resilient layer being in contact with the sealing member, wherein said resilient layer has a diameter that becomes larger nearer a longitudinal end of the developing roller in a region where the sealing member is in contact with the developing roller.

2. The developing apparatus according to claim 1, wherein the diameter has a maximum value and a minimum value, a difference between the maximum value and the minimum value is such that $10\ \mu m<\Delta\phi<300\ \mu m$ where $\Delta\phi$ is a difference between the maximum value and the minimum value.

3. A developing apparatus including a developing roller that rotates and applies developer to an electrostatic latent image formed on a photoconductive body to develop the electrostatic latent image into a visible image, and a sealing member that is in pressure contact with the developing roller to seal the developer, wherein the developing roller comprises:

a shaft that rotates; and a resilient layer that covers an outer circumferential surface of said shaft, said resilient layer being in contact with the sealing member, wherein said resilient layer has a diameter that becomes larger nearer a longitudinal end of the developing roller;

wherein the diameter has a maximum value and a minimum value, a difference between the maximum value and the minimum value is such that $10\ \mu m<\Delta\phi<300\ \mu m$ where $\Delta\phi$ is a difference between the maximum value and the minimum value; and wherein an average diameter of particles of the developer is such that $\Delta\phi>(50/\psi)+5\ \mu m$ where $\psi$ is the average diameter of the particles of the developer.

4. The developing apparatus according to claim 1, wherein said resilient layer has a resin coating formed on it.

5. The developing apparatus according to claim 4, wherein the resin coating has a thickness such that $2\ \mu m<t<100\ \mu m$ where t is the thickness.

6. The developing apparatus according to claim 1, wherein said resilient layer has an outer diameter that becomes larger nearer a longitudinal middle portion of the resilient layer.

7. The developing apparatus according to claim 6, wherein said resilient layer has a first diameter at the longitudinal middle portion of said resilient layer and a second diameter at a longitudinal end of said resilient layer, the first diameter and the second diameter are related such that $\phi end<\phi mid$ where $\phi mid$ is the first diameter and $\phi end$ is the second diameter.

8. The developing apparatus according to claim 6, wherein said resilient layer has a first diameter at a longitudinal middle portion and a second diameter at a point between the longitudinal middle portion and a longitudinal end, the second diameter being a smallest diameter across a length of said resilient layer, wherein the first diameter and the second diameter are related such that $10\ \mu m<(\phi mid-\phi A)<500\ \mu m$ where $\phi mid$ is the first diameter in μm and $\phi A$ is the second diameter in μm.

9. The developing apparatus according to claim 1, wherein the longitudinal end has a surface that lies in a plane at an angle other than 90 degrees with an axis of rotation of the developing roller.

10. The developing apparatus according to claim 1, wherein said resilient layer has an outer surface that extends to continuously become further away from an axis of rotation of the developing roller with decreasing distance from a longitudinal end of the developing roller.

11. The developing apparatus according to claim 1, wherein said resilient layer has an outer surface that extends to become further away from a rotational axis of the developing roller nearer a longitudinal end of said resilient layer, the outer surface becoming further away from the rotational axis stepwise.

12. The developing apparatus according to claim 1, wherein said resilient layer has an outer surface that becomes continuously closer to a rotational axis of the developing roller nearer a longitudinal end of said resilient layer.

13. The developing apparatus according to claim 1, further comprising a sealing member disposed to press a surface of a longitudinal end of the developing roller to seal the developer.

14. An image forming apparatus incorporating a developing apparatus according to claim 1.

* * * * *